US007377512B2

(12) United States Patent
Brickwood et al.

(10) Patent No.: US 7,377,512 B2
(45) Date of Patent: May 27, 2008

(54) LOTTERY TICKET

(75) Inventors: Michael John Brickwood, Winnipeg (CA); Lyle Harold Scrymgeour, Oakbank (CA)

(73) Assignee: Pollard Banknote Limited Partnership, Winnipeg, Manitoba (CA)

( * ) Notice: Subject to any disclaimer, the term of this patent is extended or adjusted under 35 U.S.C. 154(b) by 320 days.

(21) Appl. No.: 10/747,683

(22) Filed: Dec. 30, 2003

(65) Prior Publication Data

US 2005/0140091 A1 Jun. 30, 2005

(51) Int. Cl.
*A63F 3/06* (2006.01)

(52) U.S. Cl. ..... 273/139; 283/903

(58) Field of Classification Search ..... 273/139, 273/274, 455; 283/903; 427/96.1, 402, 427/419.1; 434/339, 346; 40/124.02, 124.03
See application file for complete search history.

(56) References Cited

U.S. PATENT DOCUMENTS

| | | | | |
|---|---|---|---|---|
| 4,310,318 | A * | 1/1982 | Carlson | 434/339 |
| 5,087,043 | A * | 2/1992 | Billings et al. | 273/157 R |
| 5,597,183 | A * | 1/1997 | Johnson | 283/83 |
| 5,973,420 | A * | 10/1999 | Kaiserman et al. | 307/139 |
| 6,142,533 | A * | 11/2000 | Borowski, Jr. | 283/111 |
| 6,188,506 | B1 * | 2/2001 | Kaiserman et al. | 359/288 |
| 6,237,913 | B1 * | 5/2001 | Kamille | 273/139 |
| 6,311,350 | B1 * | 11/2001 | Kaiserman et al. | 5/639 |
| 6,379,742 | B1 * | 4/2002 | Behm et al. | 427/7 |
| 6,951,666 | B2 * | 10/2005 | Kodas et al. | 427/376.6 |
| 2004/0053011 | A1 * | 3/2004 | Behm et al. | 428/195 |
| 2004/0235550 | A1 * | 11/2004 | McNally et al. | 463/16 |
| 2005/0255905 | A1 * | 11/2005 | Duke et al. | 463/17 |

FOREIGN PATENT DOCUMENTS

EP 1 032 865 B1 7/2003

OTHER PUBLICATIONS http://www.idtechex.com/printelecreview/en/articles/00000430.asp, Printed Electronics Review, Feb. 10, 2006.*
http://www.idtechex.com/products/en/articles/00000394.asp, IDTechEx, New announcements at Printed Electronics USA 2005, Dec. 8, 2005.*

* cited by examiner

*Primary Examiner*—William M. Pierce
(74) *Attorney, Agent, or Firm*—Adrian D. Battison; Michael R. Williams; Ryan W. Dupuis

(57) ABSTRACT

A lottery ticket is printed onto a conventional paper, card or similar substrate to provide game information printed on the substrate and game data printed on the substrate where some or all of the game data is covered by a removable covering which can be removed by the player generally by scratching a latex covering layer to expose the covered data for playing the game. In addition, a battery is printed on the substrate together with printed conductive paths, a powered element such lights or sound or a changeable ink formed on the substrate and a switch responsive to an action on the substrate by the player, generally scratching of the covering layer for conducting power from the battery to the powered element.

8 Claims, 4 Drawing Sheets

LIGHTS FLASH
JACKPOT
GAME 1
GAME 2
GAME 3
MAKES SOUNDS
ARRRRRRRRR

BLEEP!
BING!
BIKER BUCKS
$1,000
OPEN HERE
OPEN HERE
OPEN HERE
OPEN HERE

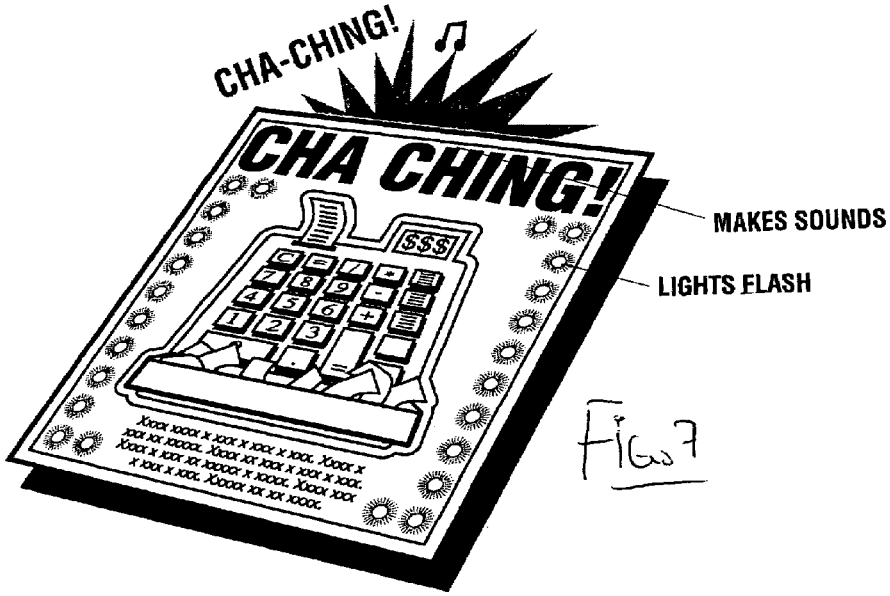
Fig 7
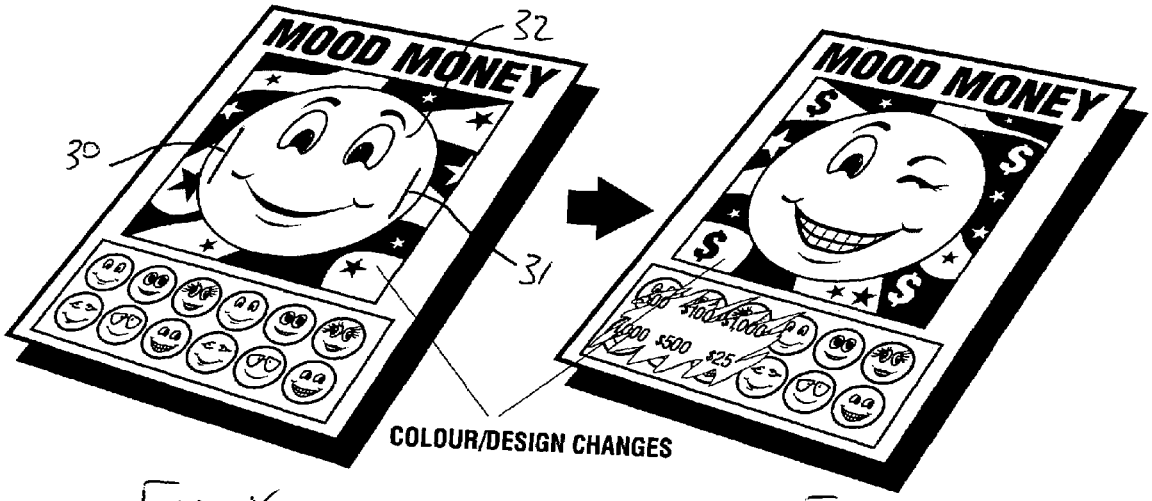
Fig 8
Fig 9

LOTTERY TICKET

The present invention relates generally to the field of lottery tickets and more particularly to a lottery ticket which includes battery power for actuating powered elements on the ticket.

BACKGROUND OF THE INVENTION

Lottery tickets are well known and widely sold and typically comprise a sheet material of paper or card stock on which is printed lottery information and various indicia for the playing of one or more games. Many such games are instant win type games where the player can play the game or games by scratching away an opaque latex coating to expose the game data.

Many attempts are being made at this present time to enhance the playing action of lottery tickets since instant win tickets necessarily must have a predetermined winning or losing condition. The tickets therefore need to provide sufficient pleasure and enjoyment for the player to encourage the purchase of further tickets but not to be so complicated that the average player is discouraged.

Much work is therefore being done to enhance the playing action by providing a series of steps that the player must undertake and modifying the conditions which are necessary for winning condition to be exposed.

Lottery tickets of this type are generally dedicated to a lottery situation in that the ticket carries substantially only information relating to the lottery and game data since the primary function is the winning and losing action of the player in the lottery game. However other fields of such tickets relate to promotional materials and fun games where there is often no monetary prize and the prizes concerned may relate merely to the promotion concerned, for example fast food or other consumer products. Other winning action may be merely of a fun nature for children where the winning of prizes in a gambling condition is unsuitable.

As an entirely different field in lottery and similar type games, there are many proposals for involvement of computers and other data communication devices by which the game playing is enhanced. However these arrangements move entirely away from the simple conventional printed ticket which is inexpensive and provides a simple playing action for the average player.

In one example Iowa Lottery authority in conjunction with Scientific Games have announced the release of a simple inexpensive computer device which carries a number of games and can be played by the player in the form of a simple calculator with keys and the like. This device is therefore entirely different from the conventional lottery ticket printed on a substrate and is directed to a different field of the market other than the average instant win ticket played by the average player.

SUMMARY OF THE INVENTION

It is one object of the present invention to provide a lottery ticket arrangement which provides an improved playing action for the player.

According to a lottery ticket construction for playing by a player comprising:

a substrate;

game information printed on the substrate;

game data printed on the substrate;

some or all of the game data being covered by a removable covering which can be removed by the player to expose the covered data for playing the game;

a battery formed on the substrate;

conductive paths formed on the substrate for conducting electric power from the battery;

at least one powered element formed on the substrate;

and a switch formed on the substrate and responsive to an action on the substrate by the player for conducting power from the battery to the at least one powered element.

The term "lottery ticket" as used herein is intended to include tickets or similar substrates which may include additional material such as promotional material where the game indicia may form a majority or a minority part of the content. The game indicia includes a game which can be played by the player to indicate a winning or losing condition, but the game may or may not involve monetary or other prizes and may therefore just be played for fun.

Preferably the battery is printed on the substrate.

Preferably the conductive paths are printed on the substrate.

Preferably the battery and the paths are on the front face of the substrate.

The lottery ticket may be a break-open type ticket which has a window formed in the substrate which can be opened to expose indicia printed behind the window but more preferably is of the type having a scratch-off layer.

Preferably the switch is arranged to be responsive to scratching of the scratch-off coating, although other forms and arrangement of switch can be used. The scratch-off layer may be that which covers the game indicia or may be a separate scratch-off layer section provided specifically for the switch action.

Preferably the scratch-off coating is formed of conductive material and the switch is responsive to changes of conductivity.

The powered element may be used to generate sound and/or lights

In another arrangement, the powered element may generate a change in color of ink printed on the substrate.

In one preferred arrangement the lottery ticket includes a row of scratch-off areas and a row of powered elements and wherein each powered element is powered in turn as a respective one of the scratch-off areas is scratched by the player.

BRIEF DESCRIPTION OF THE DRAWINGS

One embodiment of the invention will now be described in conjunction with the accompanying drawings in which:

FIGS. 4, 5, 6 and 7 are front elevational views of further examples lottery tickets using the concepts shown in FIGS. 1, 2 and 3.

FIGS. 8 and 9 are front elevational views of an embodiment wherein conduction of current through an area of a lottery ticket can be used to effect changing of the colour of the ink on an area of the ticket.

In the drawings like characters of reference indicate corresponding parts in the different figures.

DESCRIPTION OF THE PREFERRED EMBODIMENTS

Figures 1, 2:
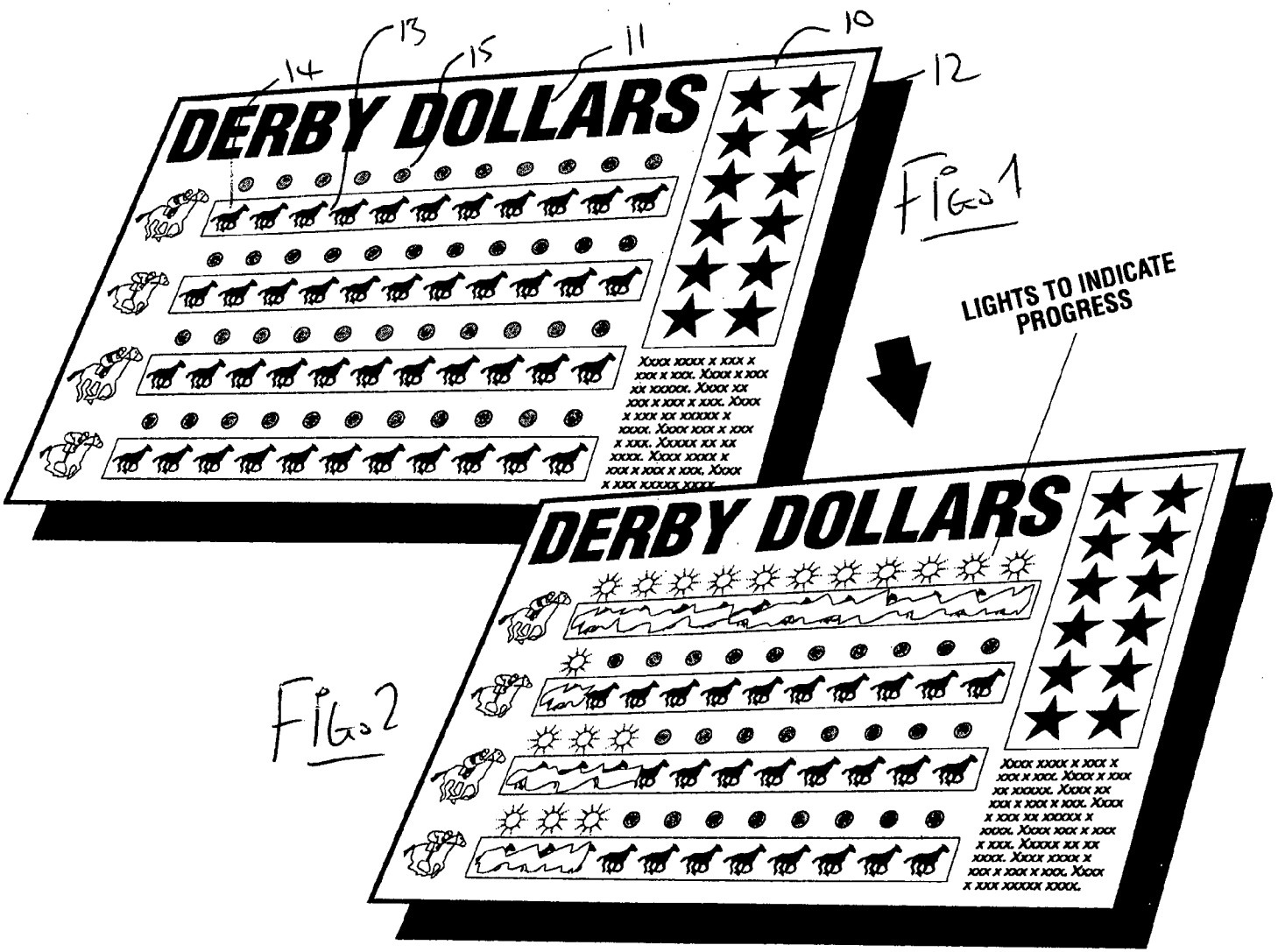
FIG. 1 is a front elevational view of one example of lottery ticket according to the present invention showing the front surface of first substrate sheet.
FIG. 2 is a front elevational view of the lottery ticket of FIG. 1 showing the ticket partly played.

In FIG. 1 is shown a lottery ticket comprising a ticket substrate 10 on which is printed lottery game information including a logo 11 and game data 12. On the ticket is printed a row of scratch off areas 13 which have a series of scratch off elements 14 arranged in a row. The ticket further includes LEDs 15 also arranged in a row with each LED adjacent a respective one of the scratch off areas.

Figure 3:
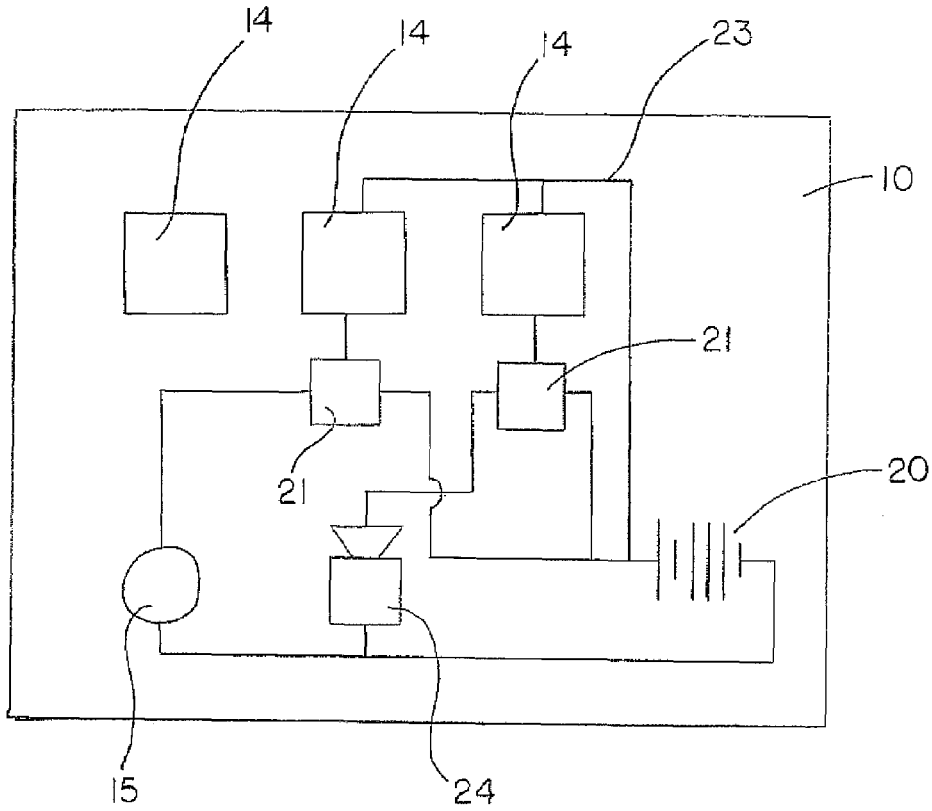
FIG. 3 is a front view of the lottery ticket of FIG. 1 showing the operating components of the lottery ticket.

The same substrate 10 is shown in FIG. 3 where the operating components are shown including the scratch off elements 14 arranged in a row. Also printed on the substrate is a printed battery 20, connected to the LEDs 15, as described below. Each scratch off area 14 is associated with a switch 21. Each scratch off area is formed from conductive ink which is connected by a conductive printed trace 23 from the battery so that the voltage is applied across the conductive ink of the scratch off layer 14. Each switch 21 can be used to operate either a sound producing component 24 or an LED or both as required. Each switch is connected to the positive supply of the battery and each switch comprises a printed semi conductor device which operates in response to detection of a change of conductivity of the scratch off area 14 associated with the switch to actuate the switch and supply current to the respective sound or light emitting element.

As will be apparent to one of skill in the art, the battery or conductive paths may be formed on the substrate in a variety of ways, for example, printed onto the substrate, formed onto the substrate, or formed or printed onto an intervening layer or other similar construction between the battery and substrate. It is to be understood that all of these arrangements are included in the meaning of the phrase "formed on the substrate".

The light emitting elements are simple LEDs which can be operated by the power from the battery to produce a light. The light can be constant or flickering as arranged and controlled by suitable semi conductor elements printed onto the substrate.

The sound producing component can be a simple element which generates a constant sound or can be a more complex arrangement which receives sound from the memory of a processor so that the sounds produced are generated from the memory and thus can be as complex or lengthy as required, depending upon the size of the memory and the complexity of the system.

The intention is that the lottery ticket maintain a conventional inexpensive construction so that the ticket itself is a very small part of the costs involved leaving a vast majority of the purchase price to be available for prizes and for lottery profit. The various components are therefore printed simply onto a conventional paper or card substrate using inexpensive printing techniques. The components printed onto the substrate can be covered by the additional parts of the ticket so that the battery, some of the conductive traces and some of the switches may be covered by the conventional game indicia overprinted onto these components.

Such printed components including batteries, semi conductor elements and conductive traces are available from commercial suppliers and can be printed onto conventional flexible substrates suitable for lottery tickets of a conventional nature. Conductive scratch off coatings are also available by providing suitable electrically conductive materials within the latex which is conventionally used as a scratch off coating.

Figures 4, 5, 6:
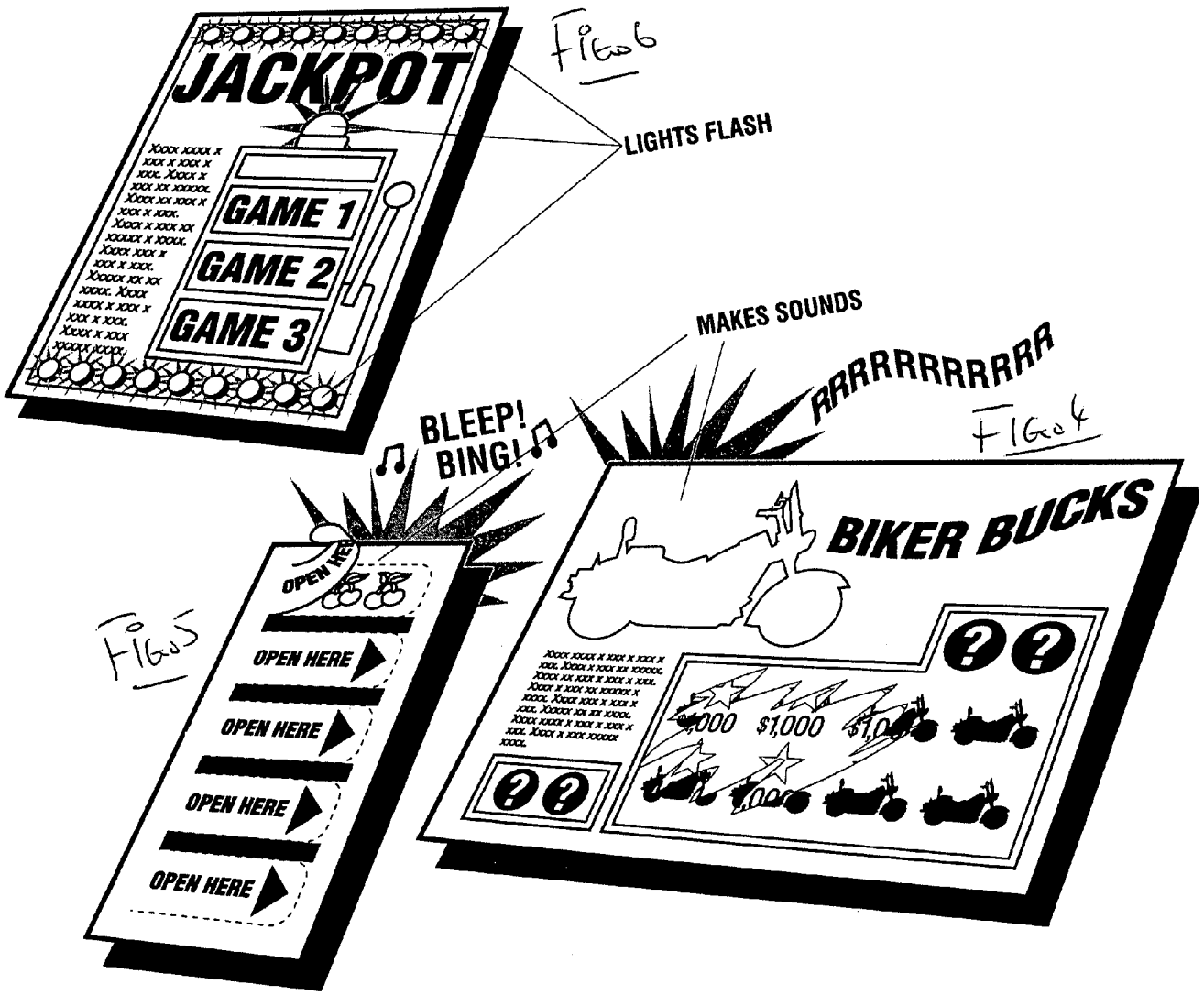

The components described above can be used in many different format and arrangements of tickets as shown for example in FIGS. 4 through 7. Thus the tickets can be used with various game concepts to enhance the playing action available to the player. Thus the LED's can be used for illuminating for example a Jackpot area as shown in FIG. 6 so that a spectacularly winning ticket is made more spectacular by the flashing of a series of lights. It will of course be appreciated that tickets of this nature are pre determined, instant-win tickets so that it is necessary only for the player to operate the playing action by effecting the scratching of some or all of the scratch components to reveal that the ticket is a winning ticket of a high win nature.

In FIG. 4 is shown an arrangement in which a sound producing component such as a component 24 is printed onto to the ticket and provides sound from a memory which is the simple sound of a motorcycle when associated with the theme of a motorcycle on the lottery ticket.

In FIG. 7 is shown an arrangement including both flashing lights and the sound producing components.

In FIG. 5 is shown an arrangement which uses the opening of a break open window on a laminated ticket product to provide the switch action for the sound and/or lights. The break open window is of a conventional type as shown where it is connected to the ticket along one side to form a hinge line and can be torn away along three sides to allow the window to be opened while remaining attached to the ticket. The switch arrangement when using a break open window can be provided by a coating on the rear surface of the window which connects to printed conductive traces printed onto the rear surface of the ticket so that when the window is opened the connection provided by the conductive rear side of the window is removed thus activating the switch as previously described.

In FIGS. 8 and 9 is shown a further arrangement where the switch obtained by scratching the winning areas of the ticket as previously described is used to supply current across a conductive area from a conductor 30 connected to the battery to a conductor 31 connected to the other side of the battery. This conduction through an area of the ticket can be used to effect changing of the colour of the ink on the area 32 of the ticket. Such changing of the color can be used to raise images not previously visible and to delete images previously visible so as to provide a change in the appearance of the area. In the example shown the area changes from FIG. 8 to FIG. 9. In the example shown, a face printed on the ticket can change from a neutral image to an image expressing surprise or joy or to an image expressing sadness depending upon the result of the scratching of the ticket and whether the ticket is a winning or losing ticket.

Inks which change on application of current through the ink are known. As an alternative arrangement, the current can be used to heat the ink with the heat being used to make a change in the color of the ink as is also commercially available and well known.

While the preferred embodiments of the invention have been described above, it will be recognized and understood that various modifications may be made therein, and the appended claims are intended to cover all such modifications which may fall within the spirit and scope of the invention.

The invention claimed is:

1. A lottery ticket construction for playing by a player comprising:

a substrate;

game information printed on the substrate;

game data printed on the substrate;

some or all of the game data being covered by a removable covering in the form of a scratch-off layer which can be removed by the player by scratching to expose the covered data for playing the game;

a battery formed on the substrate;

conductive paths formed on the substrate for conducting electric power from the battery;

at least one powered element formed on the substrate;

and a switch formed on the substrate and responsive to an action on the substrate by the player for conducting power from the battery to the at least one powered element;

wherein the scratch-off layer is formed of conductive material;

and wherein the switch is arranged to be responsive to changes of conductivity caused by scratching of the scratch-off layer.

2. The lottery ticket according to claim 1 wherein the battery is printed on the substrate.

3. The lottery ticket according to claim 1 wherein the conductive paths are printed on the substrate.

4. The lottery ticket according to claim 1 wherein the battery and the paths are on a front face of the substrate.

5. The lottery ticket according to claim 1 wherein the powered element generates sound.

6. The lottery ticket according to claim 1 wherein the powered element generates lights.

7. The lottery ticket according to claim 1 wherein the powered element generates a change in color of ink printed on the substrate.

8. The lottery ticket according to claim 1 wherein the lottery ticket includes a row of scratch-off areas and a row of powered elements and wherein each powered element is powered in turn as a respective one of the scratch-off areas is scratched by the player.

* * * * *